US008096399B2

(12) United States Patent
Haggstrom et al.

(10) Patent No.: US 8,096,399 B2
(45) Date of Patent: Jan. 17, 2012

(54) COIN LOCK

(75) Inventors: Ake Haggstrom, Lycksele (SE); Rolandh Jonsson, Lycksele (SE)

(73) Assignee: Assa AB, Eskilstuna (SE)

( * ) Notice: Subject to any disclaimer, the term of this patent is extended or adjusted under 35 U.S.C. 154(b) by 0 days.

(21) Appl. No.: 12/491,080

(22) Filed: Jun. 24, 2009

(65) Prior Publication Data

US 2010/0006390 A1 Jan. 14, 2010

(30) Foreign Application Priority Data

Jul. 11, 2008 (SE) ..... 0801671

(51) Int. Cl.
*G07F 5/02* (2006.01)

(52) U.S. Cl. ..... 194/247; 70/DIG. 41

(58) Field of Classification Search ..... 194/247, 194/290; 70/DIG. 41
See application file for complete search history.

(56) References Cited

U.S. PATENT DOCUMENTS 3,621,965 A * 11/1971 Ten Eicken ..... 194/253
4,572,348 A * 2/1986 Eisermann et al. ..... 194/248

FOREIGN PATENT DOCUMENTS

DE 103 50 951 A1 * 5/2005

* cited by examiner

*Primary Examiner* — Mark Beauchaine
(74) *Attorney, Agent, or Firm* — Holland & Hart LLP

(57) ABSTRACT

Coin lock comprising a lock housing (1) with two coin openings (2, 3) for insertion of coins (A, B) which enable operation of the coin lock, a bolt piece (8) which is connected to a bolt (9) and is arranged in the lock housing and able to move between a forward and a rear position, and a first and a second coin sensing device, each of which comprises a first (31, 31', 34-, 34') and a second (32, 32', 35; 35') carrier device to carry a coin with a predetermined minimum diameter, inserted through one of the coin openings, and a hook (14, 15) which; in absence of a coin with the predetermined minimum diameter, borne by the carrier device, and engaging with the bolt piece, prevents the bolt piece from being moved to the forward position, and which, in the presence of a coin with the predetermined minimum diameter, borne by the carrier device, allows the bolt piece to be moved into the forward position. The carrier devices (31, 31', 32, 32', 34, 34', 35, 35') of the first and second coin sensing devices are arranged at the same side of the bolt piece (8).

10 Claims, 6 Drawing Sheets

COIN LOCK

BACKGROUND AND FIELD OF THE INVENTION

The invention relates to a coin lock and more specifically to a coin lock of the kind indicated in the preamble of claim 1.

Such coin locks can be used, for example, in cabinets and storage boxes at public places such as sports halls, public swimming baths, train stations, airports and the like.

The coin locks can operate on the pawn principle, when the coin inserted is returned after use, or on the pay principle, when the coin is not returned.

With such coin locks it can be desirable for the lock to operate only after two coins have been inserted in the lock. In particular, it can be desirable for two coins of different value to be required to operate the lock.

PRIOR ART

EP 0 945 836 A describes a coin lock which can be operated after a coin has been inserted in the lock. Thus, with this lock, it is not possible to require insertion of two coins to enable the use of the lock.

DE 31 24 180 A1 describes a coin lock which can be adjusted such that it requires the insertion of two identical coins to operate the lock. However, this lock does not allow the lock to operate only after different coins, that is to say two coins of different value, have been inserted in the lock.

DE 103 50 951 B4 describes a coin lock which comprises a lock housing in which a bolt can move by means of a key between a retracted and an advanced position. The lock moreover comprises a first and a second detention device for a first and a second coin, and a first and a second releaseable blocking device. The two blocking devices prevent movement of the bolt if there is no coin in the respective detention device and enable movement of the bolt when a coin is present in the respective detention device. In the lock described in DE 103 50 951 B4, the first detention device is arranged at one side of the bolt, while the second detention device is arranged at the other side of the bolt. In this way, two separate coin tracks are formed, being arranged on either side of the bolt. With this coin lock, it is possible to require insertion of two coins of different value to enable operation of the lock. However, the lock is relatively complicated and requires a relatively large thickness crossways to the direction of movement of the bolt. Furthermore, when using the coin lock just described, it is necessary to insert the two coins in coin openings which are not arranged in the same plane, i.e. which are not lined up with each other. This can be a disadvantage for the use of the lock.

BRIEF ACCOUNT OF THE INVENTION

One object of the invention is therefore to provide an improved coin lock requiring the insertion of two coins to enable operation of the coin lock.

Another object is to provide such a coin lock which is simple and space-saving, and which has a relatively slight thickness.

Yet another object is to provide such a coin lock which is simple and whose use is intuitive, and easy to understand.

These and other objects are achieved with a coin lock of the kind indicated in the preamble of claim 1 and having the features indicated in the characterizing part.

The coin lock according to the invention comprises a lock housing with two coin openings for insertion of coins which enable operation of the coin lock, and a bolt piece which is connected to a bolt and is arranged in the lock housing and able to move between a forward and a rear position. The coin lock furthermore comprises a first and a second coin sensing device, each of which comprises a first and a second carrier device to carry a coin with a predetermined minimum diameter, inserted through one of the coin openings, and a hook. The hook of each coin sensing device is arranged such that, in absence of a coin with the predetermined minimum diameter, borne by the carrier device, and engaging with the bolt piece, it prevents the latter from being moved to the forward position, and, in the presence of a coin with the predetermined minimum diameter, borne by the carrier device, it allows the bolt piece to be moved into the forward position. According to the invention, the carrier devices of the first and second coin sensing devices are arranged at the same side of the bolt piece.

In this way, two coin tracks are formed, both of which are arranged in the same plane, on the same side of the bolt piece. Since all the carrier devices are arranged on the same side of the bolt piece, they protrude in the same direction from the bolt piece. In this way it is possible to reduce the total thickness across the bolt piece of the coin lock as compared to what is necessary when carrier devices are arranged on both sides and protrude in opposite directions from the bolt piece. Since the coin tracks are formed in the same plane on one side of the bolt piece, it is furthermore possible to arrange the two coin openings in the same plane and in line with each other, which contributes to a simplified handling of the coin lock as compared to coin locks where the coin openings are arranged in different planes.

The carrier devices of the first coin sensing device are expediently arranged displaced in the direction of movement of the bolt piece in relation to the carrier devices of the second coin sensing device. In this way, the two coin tracks are separated from each other, which reduces the risk of the two coins knocking against each other or otherwise disturbing each other's movement through the coin lock.

The first coin sensing device's first carrier device is expediently secured to a first slide which can move relative to the bolt piece. This allows in a simple manner for the carrier devices of the first coin sensing device to be separated from each other during the completed displacements of the bolt piece to the forward position, allowing the coin to drop down in the lock, for example into an intermediate storage station or directly into a coin return container or a paid coin container.

In a corresponding manner, the second coin sensing device's first carrier device is expediently secured to a second slide, which can move relative to the bolt piece.

The two slides can be fashioned as one piece or can be coupled to each other such that they are fixed in relation to each other. This allows, among other things, simultaneous manual release of the two coins from their respective carrier devices, for example by pressing in a common coin return button for the two slides. Alternatively, the two slides can be separated from each other and able to move relative to each other. Such a separate configuration is advantageous, for example, if it is desirable in certain applications to use only one coin track to enable operation of the lock after insertion of one coin. The separate configuration furthermore permits a combination of automatic release of the one coin and manual release of the other coin, for example by pressing a button.

The first and/or the second coin sensing device's first carrier devices are expediently fixable in various positions of the first and second slide, respectively. This permits simple adjustment of the predetermined minimum diameter of a coin that will be borne by the carrier devices of the respective coin sensing device.

The bolt piece expediently has a through opening which is designed to allow passage of a coin from the side of the bolt piece on which the first and second coin sensor's carrier devices are arranged to the side of the bolt piece opposite the carrier devices. This achieves a greater freedom of choice regarding the choice and placement of the return coin and pay coin containers.

When using such a through opening in the bolt piece, at least one of the first and second slides expediently has a flange sticking out from the bolt piece to steer a coin through the bolt piece's continuous opening. This permits simple and functionally reliable guidance of the coin through the opening of the bolt piece, for continued transport, e.g. down to an entrance of a pay coin container situated on the side of the bolt piece opposite the carrier devices. By replacing this slide with a slide not having such a flange sticking out, it is furthermore possible to easily readjust the coin lock such that this coin is instead taken further from the carrier devices to a return coin container situated on the same side of the bolt piece as the carrier devices.

Further advantages and characteristics of the coin lock according to the invention will appear from the following detailed description of illustrative embodiments and from the claims.

BRIEF DESCRIPTION OF THE FIGURES

Illustrative embodiments of the invention are described below with reference to the figures, in which.

DETAILED DESCRIPTION OF ILLUSTRATIVE EMBODIMENTS

Figure 1:
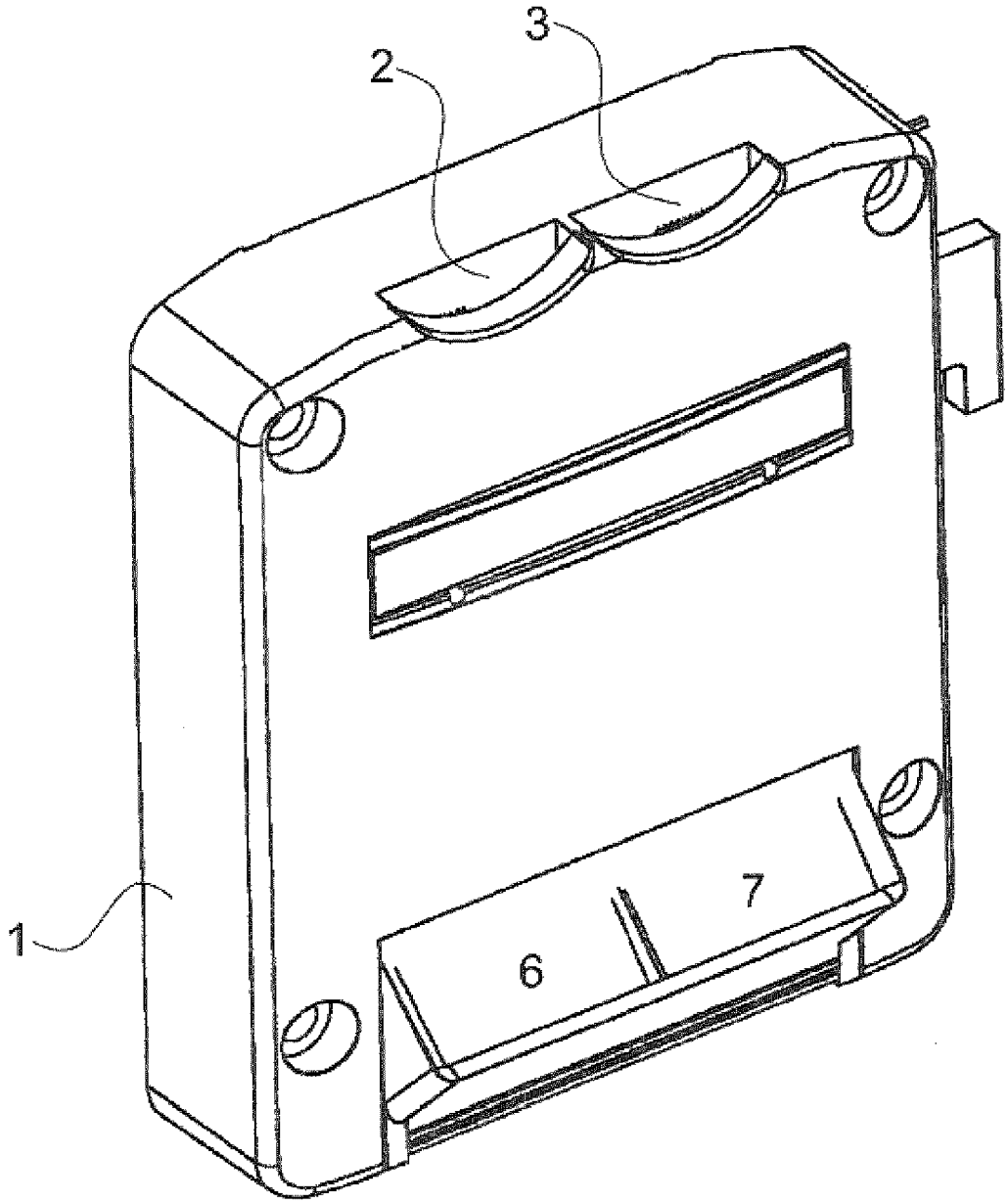
FIG. 1 is a perspective view of a coin lock according to a first embodiment of the invention.
Figure 2:
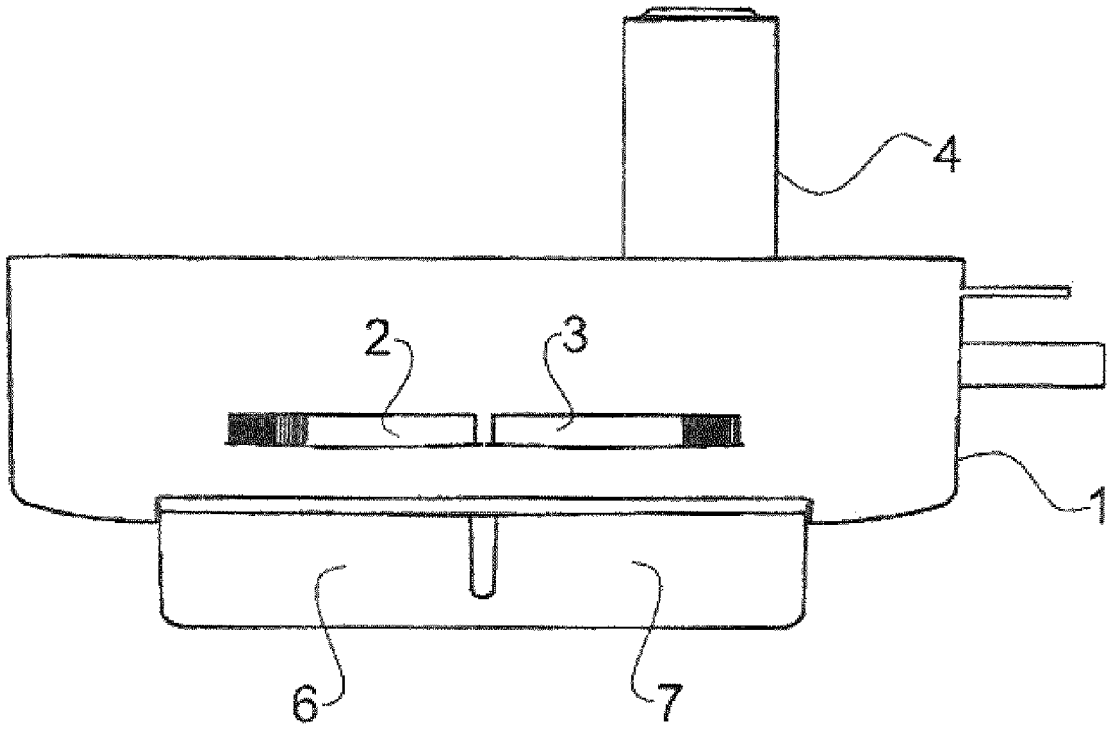
FIG. 2 is a plan view from above of the coin lock according to the embodiment shown in FIG. 1.
Figure 3:
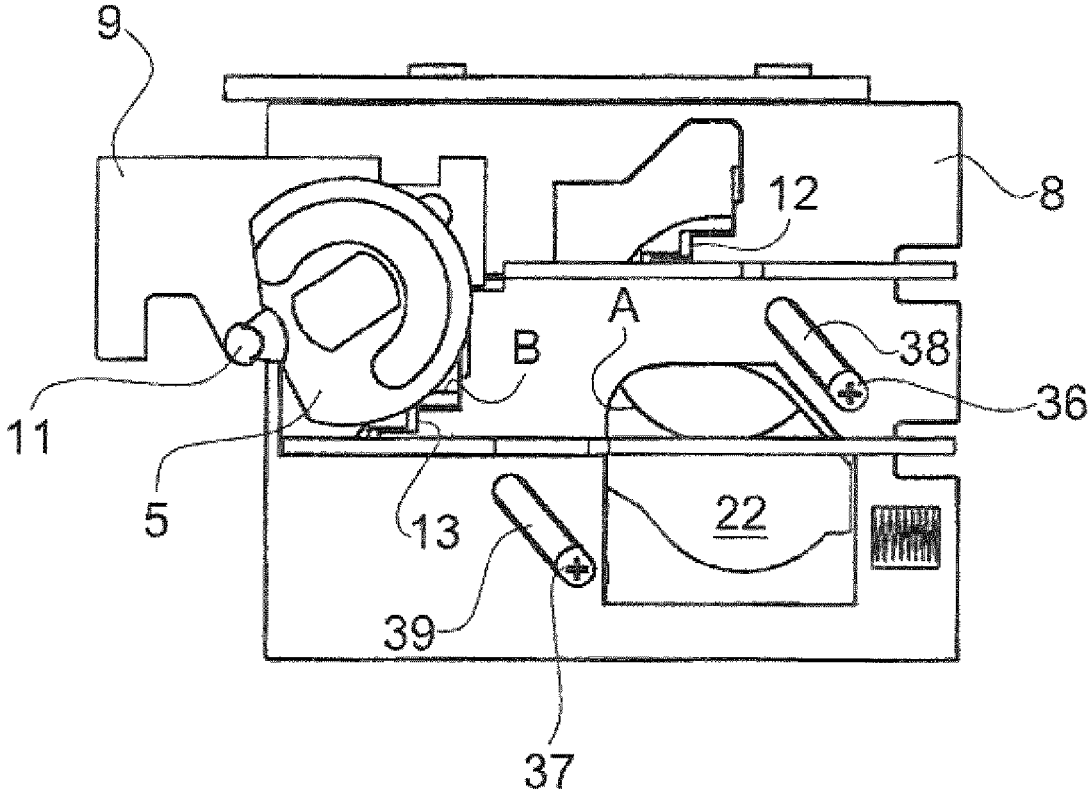
FIG. 3 is a schematic plan view from one side of certain parts of the coin lock according to the embodiment shown in FIG. 1.

The coin lock shown in FIG. 1-4 comprises a lock housing 1 or a lock box which has two oblong coin openings 2, 3 arranged in line with each other for insertion of a first (A) and a second (B) coin. The coin lock also comprises a lock cylinder 4, whose core (not shown) engages with a follower 5. A first 6 and a second 7 coin return container are arranged at the lower part of the coin lock and are accessible from the outside of the coin lock. In the lock housing, a bolt piece 8 is able to move between a rear and a forward position. A bolt 9 is firmly connected via a screw 10 to the bolt piece 8 and can move relative to the lock housing together with the bolt piece 8. The follower 5 is connected to the bolt by means of a pin 11. The lock housing 1, the bolt piece 8, the bolt 9 and the follower 5 are configured such that rotation of the follower in a locking direction first produces an essentially horizontal displacement of the bolt 9 and the bolt piece 8 to a forward extended position and then an essentially vertical downward displacement of the bolt 9 and the bolt piece 8, whereupon the bolt 9 can engage with a striking plate (not shown) or the like. Rotation of the follower 5 in an opposite, unlocking direction produces in a corresponding manner first a vertical upward displacement of the bolt 9 and the bolt piece 8 and then a horizontal displacement toward a rear retracted position of the bolt 9 and the bolt piece 8.

The bolt piece 8 furthermore has a first 12 and a second 13 step-shaped stop, each of which has a number of stop steps. A first 14 and a second 15 hook is fixed in pivoting fashion to the lock housing 1 and designed to engage, in a respective swiveled down position, with the first 12 and second 13 step-shaped stop, so as to prevent displacement of the bolt piece 8 in the direction of the forward position.

Figure 4:
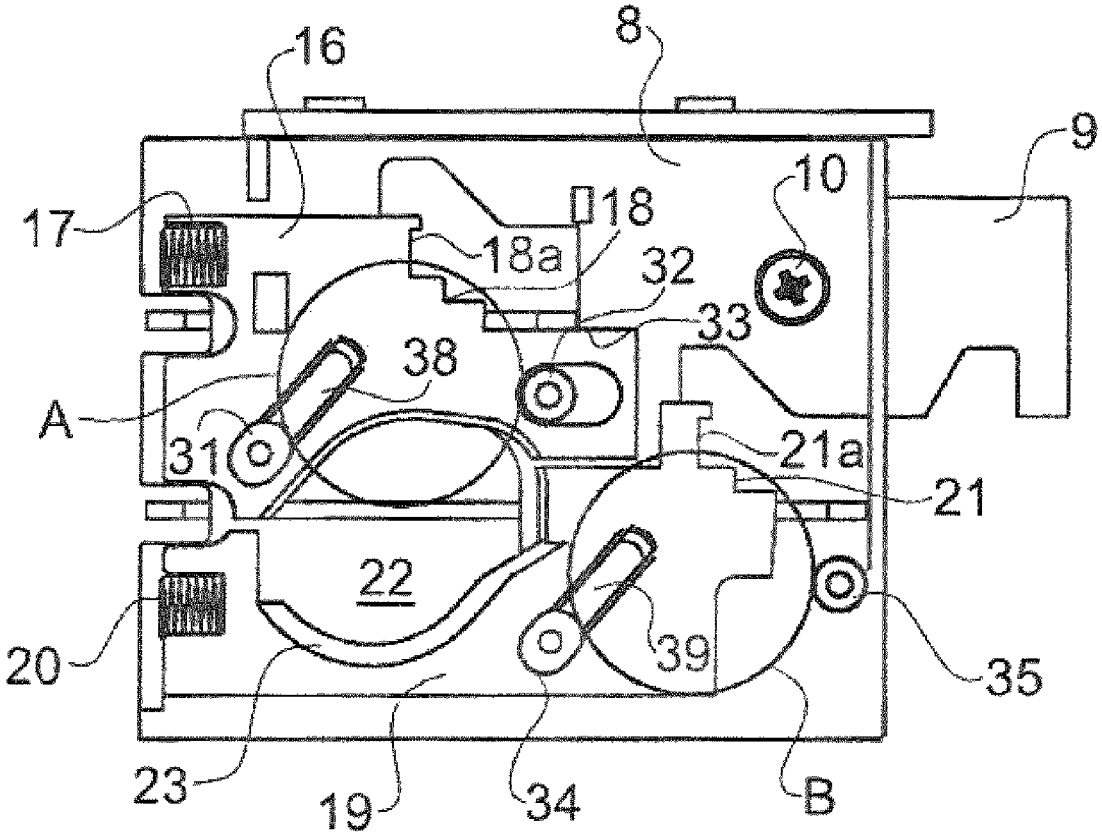
FIG. 4 is a schematic plan view corresponding to that in FIG. 3, but from the other side.

As is shown most clearly in FIG. 4, a first upper slide 16 is arranged at the bolt piece 8, on its one side. The first slide 16 can move horizontally to a limited degree in relation to the bolt piece 8. A first spring 17 is arranged between the bolt piece 8 and the first slide 16 to return the slide 16 to its starting position relative to the bolt piece 8 when it has been moved relative to the bolt piece 8. The first slide 16 has a step-shaped stop 18 with a number of stop steps and an upper vertical stop 18*a*.

A second lower slide 19 is arranged in a corresponding manner at the bolt piece 8, on the same side of the bolt piece as the first slide 16. The second slide 19, like the first 16, can move horizontally to a limited degree in relation to the bolt piece 8. A second spring 20 is arranged between the bolt piece 8 and the second slide 19 to return the second slide 19 to its starting position relative to the bolt piece 8 when it has been moved relative to the bolt piece 8. The second slide 19 also has a step-shaped stop 21 with a number of stop steps and an upper vertical stop 21*a*.

The bolt piece 8 also has a through opening 22, and the second slide 19 comprises a guide flange 23 sticking out from the bolt piece 8 and arranged in front of the through opening 22 in the bolt piece 8.

The coin lock comprises a first and a second coin sensing device. The first coin sensing device comprises the first hook 14, a first, carrier device 31 which is attached to the first slide 16, and a second carrier device 32 which is attached to the bolt piece 8 and which extends through an oblong hole 33 made in the first slide 16. The second coin sensing device comprises the second hook 15, a first carrier device 34 which is attached to the second slide 19, and a second carrier device 35 which is attached to the bolt piece 8.

The carrier devices 31, 32, 34 and 35, in the example depicted, are cylindrical sleeves which stick out in the same direction from the bolt piece 8. The first two carrier devices 31, 34 are attached to the first 16 and second 19 slide, respectively, each by means of a screw 36, 37 which extends through an oblong continuous slot 38, 39, arranged in the first 16 and second 19 slide, respectively. In this way, it is possible to fix the two first carrier devices 31, 34 in different positions on the first 16 and second 19 slide, respectively, so as to thereby vary the mutual spacing between the first 31, 34 and second 32, 35 carrier devices on the first 16 and second 19 slide, respectively. To facilitate access to the screws 36, 37, corresponding slots 51, 52 are also arranged through the bolt piece 8, the same as in the lock housing. This permits simple adjustment of the first and second coin sensing devices in order to accommodate coins of different diameter and value. By virtue of the slots 51, 52 in the bolt piece 8 and in the lock housing, it is possible to bring about such an adjustment from outside the lock housing, without needing to open it up.

When operating the coin lock shown in FIG. 1-4, one introduces a first coin A into the first coin opening 2 and a second coin B into the second coin opening 3. The figures show an application where the spacing between the first 31 and second 32 carrier device of the first coin sensing device is equal to the corresponding spacing for the second coin sensing device and thus where the inserted coins A and B have the same diameter and value. However, it is evident that the spacing between the carrier devices 31, 32 of the first coin sensing device can differ from the spacing between the carrier devices 34, 35 of the second coin sensing device in order to thereby enable operation of the coin lock only when two coins with different minimum diameters are inserted in the respective coin opening provided for this.

When the coins A and B have been introduced through the respective coin opening, the coin A drops down and comes to lie against the first 31 and second 32 carrier device of the first coin sensing device. The second coin B drops down and comes to lie against the first 34 and second 35 carrier device of the second coin sensing device. If the follower 5 is rotated in the locking direction by means of a key inserted in the lock cylinder 4 in this position, the bolt piece 8 and the two slides 16 and 19 will be displaced a slight distance horizontally to the forward position. During this horizontal displacement, the two hooks 14, 15 will slide along the peripheral surface of the coins A and B, respectively, such that the hooks 14, 15 are released from the step-shaped stops 18, 21 at the first 16 and second 19 slide, as well as from the step-shaped guides 12, 13 at the bolt piece 8. The bolt piece 8 and the two slides 16, 19 are thus allowed continued movement toward the forward position.

During the continued movement, the hooks 14, 15 come to lie against their respective upper vertical stops 18*a*, 21*a* at the first 16 and second 19 slide. The two slides 16, 19 are thereby prevented from continuing to move, while the bolt piece is further displaced to the forward position. In this way, the spacing between the first 31, 34 and second 32, 35 carrier devices of the first and second coin sensing devices increases such that the coins A, B can drop down between their respective carrier devices. During this relative movement between the bolt piece 8 and the first 16 and second 19 slide, respectively, the two springs 17, 20 are compressed.

Continued turning of the follower in the locking direction then imparts to the bolt piece 8 and the bolt a downward vertical movement, such that the bolt can engage with a striking plate or the like and take up its forward locked position.

When the first coin A drops down between the carrier devices 31, 32, it abuts against the projecting flange 23 and is thereby led in through the through opening 22 in the bolt piece. The first coin A is then led down to an entrance of a pay coin container (not shown) located beneath the lock housing, which entrance is situated at the side of the bolt piece 8 opposite the carrier devices 31, 32, 34, 35 and underneath the latter. The second coin B drops down between the carrier devices 34, 35 to the coin return container 7, situated beneath these, where the user can retrieve it. The coin lock is expediently arranged on the inside of a locker door or the like, such that the return coin can only be retrieved after the coin lock has been unlocked once again and the locker door opened.

When the coin lock is to be unlocked, the follower 5 turns by means of the key in the opposite unlocking direction, whereupon the bolt 9 and the bolt piece 8 are first lifted vertically upward such that the bolt is disengaged from the striking plate. Continued turning of the follower 5 in the unlocking direction then imparts to the bolt 9 and the bolt piece 8 a horizontal displacement in the direction of the rear position. During this displacement, the springs 17, 20 press the two slides 16, 19 to their respective starting positions relative to the bolt piece. Then the hooks 14, 15 slide stepwise down the step-shaped guides 18, 21 on the slides 16, 19 and the step-shaped guides 12, 13 of the bolt piece 8, without hindering the movement of the bolt piece 8 and the two slides 16, 19 back to the rear position.

Figure 5:
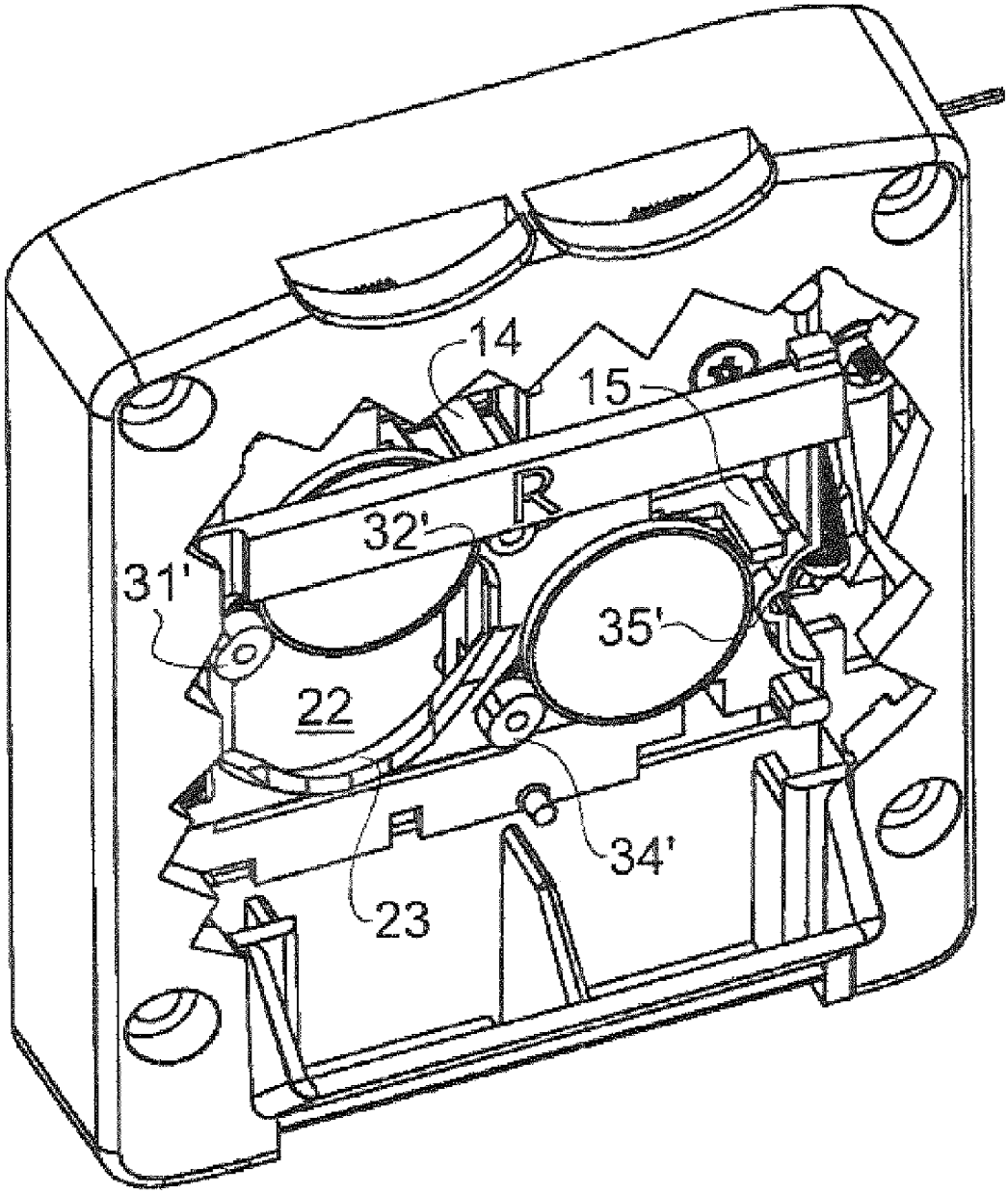
FIG. 5 is a perspective view, with certain parts taken away, of a coin lock according to a second embodiment.
Figure 6:
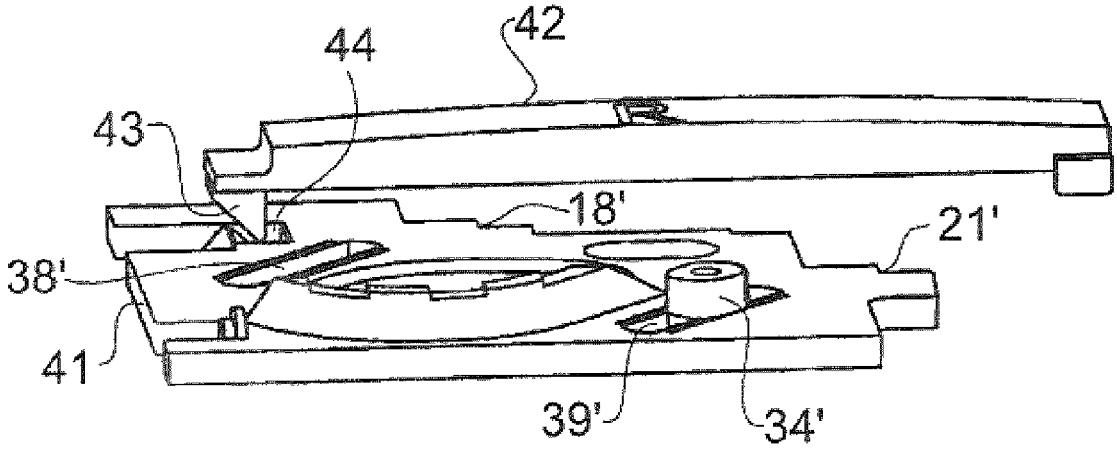
FIG. 6 is a perspective view of certain parts of the coin lock according to the embodiment shown in FIG. 5.

In the embodiment shown in FIGS. 5 and 6, the coin lock comprises only one slide 41, which can move in limited fashion relative to the bolt piece. The slide 41 has two slots 38', 39', on which the first carrier devices 31', 34' of the first and second coin sensing devices, respectively, are attached in a way corresponding to that described above. This embodiment lacks the upper vertical stops for the hooks 14, 15. The coin lock according to this embodiment functions for the most part like the above-described coin lock, but it differs from the latter in that the hooks 14, 15 do not bring about any increase in the spacing between the first 31', 34' and second 32', 35' carrier devices during movement of the bolt piece in the direction of the forward position. Instead, there occurs a separation of the first carrier devices 31', 34' from the second carrier devices 32', 35' for release of the coin, manually by pressing a button 42, which by means of a wedge-shaped projection 43, abutting against a cavity 44 in the slide 41, presses the slide 41 so that the first carrier devices 31', 34' are moved in the direction away from the second carrier devices 32', 35'.

The coin lock according to the invention furthermore allows the lock housing to be configured with a relatively slight thickness and permits a simple and easily understandable operation, along with a high degree of flexibility and freedom of choice in regard to the choice and placement of different containers for return coins and/or pay coins. Moreover, the coin lock of the invention enables a modular design, where the coin lock can be easily adapted for a series of different applications by adding, removing, or replacing a single or a number of standardized modular components.

Illustrative embodiments of the coin lock according to the invention have been described above. However, it will be appreciated that the invention is not limited to these illustrative embodiments and instead can be freely varied within the scope of the attached claims. For example, instead of the bolt being designed as a component attached to the bolt piece, it can form a single component with the bolt piece. In the examples shown, the bolt is a hook bolt, but it is obvious that the bolt instead can be of a straight type or any other suitable type. Furthermore, the movement of the bolt piece between the rear and forward positions can describe paths of movement other than two consecutive rectilinear displacements.

The invention claimed is:

1. A coin lock comprising a lock housing with two coin openings for insertion of coins which enable operation of the coin lock, a bolt piece which is connected to a bolt and is arranged in the lock housing and able tot move between a forward and a rear position, and a first and a second coin sensing device, each, of which comprises a first and a second carrier device to carry a coin with a predetermined, minimum diameter, inserted through one of the coin openings, and a hook which, in absence of a coin with the predetermined minimum diameter, borne by the carrier device, and engaging with the bolt piece, prevents the bolt piece from being moved to the forward position, which, in the presence of a coin with the predetermined minimum diameter, borne by the carrier device, allows the bolt piece to be moved into the forward position, characterized in that that carrier devices of the first and second coin sensing devices are arranged on the same side of the bolt piece.

2. The coin lock according to claim 1, wherein the carrier devices of the first coin sensing device are arranged displaced in the direction of movement of the bolt piece in relation to the carrier devices of the second coin sensing device.

3. The coin lock according to claim 1, wherein the first coin sensing device's first carrier device is secured to a first slide, which can move relative to the bolt piece.

4. The coin lock according to claim 3, wherein the second coin sensing device's first carrier device is secured to a second slide, which can move relative to the bolt piece.

5. The coin lock according to claim 4, wherein the second slide is able to move relative to the first slide.

6. The coin lock according to claim 3, wherein the first and/or the second coin sensing device's first carrier devices are fixable in various positions of the first and second slide, respectively, to permit adjustment of the predetermined minimum diameter of a coin that will be borne by the carrier devices of the respective coin sensing device.

7. The coin lock according to claim 1, wherein the bolt piece has a through opening which is designed to allow passage of a coin from the side of the bolt piece on which the first and second coin sensors carrier devices are arranged to the side of the bolt piece opposite the carrier devices.

8. The coin lock according to claim 7, wherein at least one of a first slide and a second slide has a flange sticking out from the bolt piece to steer a coin through the bolt piece's through opening.

9. A coin lock comprising a lock housing with two coin openings for insertion of coins which enable operation of the coin lock, a bolt piece which is connected to a bolt and is arranged in the lock housing and able to move between a forward and a rear position, the bolt piece has a through opening, and a first and a second coin sensing device; each of which comprises a first and a second carrier device to carry a coin with a predetermined minimum diameter, inserted through one of the coin openings, and a hook which, in absence of a coin with the predetermined minimum diameter, borne by the carrier device, and engaging with the holt piece, prevents the bolt piece from being moved to the forward position, and which, in the presence of a coin with the predetermined minimum diameter, borne by the carrier device, allows the bolt piece to be moved into the forward position, characterized in that the through opening of the bolt piece allows passage of a coin from the side of the bolt piece on which the first and second coin sensor's carrier devices are arranged to the side of the bolt piece opposite the carrier devices and the carrier devices of the first and second coin sensing devices are arranged on the same side of the bolt piece.

10. The coin lock according to claim 9, wherein at least one of a first slide and a second slide has a flange sticking out from the bolt piece to steer a coin through the bolt piece's through opening.

* * * * *